US008100747B2

(12) United States Patent
Singer et al.

(10) Patent No.: US 8,100,747 B2
(45) Date of Patent: Jan. 24, 2012

(54) SYSTEM AND METHOD OF CONDUCTING AN AUCTION BASED GAME

(75) Inventors: Kathy Karwat Singer, New York, NY (US); Christopher Teas, Atlantic Highlands, NJ (US); Jay Gissen, Ossining, NY (US); William Shapiro, Venice, CA (US)

(73) Assignee: Bobkat Productions, LLC, New York, NY (US)

( * ) Notice: Subject to any disclaimer, the term of this patent is extended or adjusted under 35 U.S.C. 154(b) by 997 days.

(21) Appl. No.: 11/786,133

(22) Filed: Apr. 11, 2007

(65) Prior Publication Data

US 2007/0235932 A1 Oct. 11, 2007

Related U.S. Application Data

(60) Provisional application No. 60/791,014, filed on Apr. 11, 2006.

(51) Int. Cl.
*A63F 9/24* (2006.01)

(52) U.S. Cl. ..... 463/9; 463/11; 463/12; 463/13; 463/42

(58) Field of Classification Search ..... 463/9, 11, 463/12, 13, 42
See application file for complete search history.

(56) References Cited

U.S. PATENT DOCUMENTS

| | | | | |
|---|---|---|---|---|
| 5,332,219 | A * | 7/1994 | Marnell et al. | 463/13 |
| 6,468,159 | B1 * | 10/2002 | La Mura et al. | 463/42 |
| 7,614,958 | B2 * | 11/2009 | Weston et al. | 473/62 |
| 2004/0033833 | A1 * | 2/2004 | Briggs et al. | 463/42 |
| 2005/0113170 | A1 * | 5/2005 | McHugh | 463/40 |
| 2006/0247058 | A1 * | 11/2006 | Kromer | 463/42 |
| 2006/0265277 | A1 * | 11/2006 | Yasinovsky et al. | 705/11 |

* cited by examiner

*Primary Examiner* — Pierre Eddy Elisca
*Assistant Examiner* — Shahid Kamal
(74) *Attorney, Agent, or Firm* — Gerald E. Hespos; Michael J. Porco

(57) ABSTRACT

A system and method for conducting a game including a first question and answer round (or alternatively, a physical challenge round) where a contestant can accumulate points and a second auction round where the contestant can bid on lots/prizes with the accumulated points. The system and method provide for presenting at least one of a mental or physical challenge to the at least two players; crediting a predetermined number of points to each of the at least two players based on an outcome of the challenge; auctioning at least one predetermined prized to the at least two players, the at least two players using the credited points to bid for the predetermined prize; and awarding the at least one predetermined prize to one of the at least two players with the highest bid.

27 Claims, 5 Drawing Sheets

SYSTEM AND METHOD OF CONDUCTING AN AUCTION BASED GAME

This application claims priority on U.S. Provisional Patent Appl. No. 60/791,014, filed Apr. 11, 2006.

BACKGROUND OF THE INVENTION

1. Field of the Invention

The present disclosure relates generally to gaming and game shows, and more particularly, a system and method for conducting a game including a first question and answer round where a contestant can accumulate points and a second auction round where the contestant can bid on lots/prizes with the accumulated points.

2. Description of the Related Art

Keeping a group of ten-year old schoolchildren quiet, orderly, happily entertained and actually learning something worthwhile on their own initiative for periods of an hour or more is a challenge. Any parent or teacher can tell you that the need for results like this is urgent, constant and universal. The challenge lies in presenting learning objectives in a medium the children are familiar with and have a desire to be involved in, for example, competitive gaming.

Game shows have been and remain a staple of television broadcasting virtually from its inception as a broadcast medium. At the height of its popularity, a good game can deliver some of the highest ratings on TV. Game shows present entertainment in the form of conflict. The conflict lies in the competition between the players for the prizes.

Thus, a need exists for a gaming system and method thereof that emphasizes core educational learning objectives including mathematics, language and communication skills combined with advanced gaming strategy.

SUMMARY OF THE INVENTION

A system and method of playing a game is provided. The game is structured in two-parts: a question and answer Trivia Round (or alternatively, a physical challenge round) followed by an Auction Round. Contestants of the game bid on lots/prizes during the Auction Round using points, instead of actual money, that they have accumulated during the Trivia Round.

The objective of the game is to win a lot/prize during an Auction Round by being the highest bidder. In one embodiment, five (5) contestants are selected at random to play the game from a pool of potential contestants. There are only three auction winners of the selected contestants. Each contestant may only win one lot/prize. Once a contestant wins a lot/prize, the contestant is out of the game. However, a contestant must first accumulate points based upon their total number of correct answers to a series of ten (10) questions before they can participate in the auction. Correct answers are awarded points, however, incorrect answers are not penalized. In alternative embodiments, contestants may also accumulate points by performing physical challenges. Contestants bid with the points they earned from the Trivia Round during the Auction Round. Successful contestants utilize a combination of bidding strategy, bluffing technique and logic during the auctions.

In the Trivia Round, contestants attempt to answer questions having numerical point values assigned to the correct answers, with the more difficult ones being worth more points. Contestants are able to immediately determine whether they have answered questions correctly, however, they are unaware of their opponent's point valuation. Since none of the contestants know the number of points that their competitors have accumulated at the end of the Trivia Round, there is substantial suspense entering the Auction Round.

During the Auction Round, three lots/prizes are auctioned. The lots/prizes are drawn randomly from a pool of potential lots/prizes, e.g., a predetermined catalog. Contingent upon the demographic selected for the game, the lots/prizes include toys, games, trips, consumer goods, sporting goods and other age specific awards. A key element is that the contestants are not aware of the order that any of the lots/prizes will appear during the auction. This creates suspense for contestants in determining whether or not they should bid on a specific lot/prize, or if it would be more advantageous to hold out for a better lot/prize that may appear later in the round. The threat is that the contestant may not have enough points to be the winning bidder if they hold out too long. Conversely, the highest valued lot/prize could be the first one auctioned.

In other aspects of the present disclosure, the game can be provided in many different environments, for example, including but not limited to a computing environment including an online environment, a web-based environment, or general computing environment; a television environment in a game show format; a radio environment in a radio talk show format; or a wireless communications environment in a cellular or mobile phone game format. In other aspects, a computer readable medium includes game components that presents prerecorded media data. Furthermore, the game may be provided as a board game.

According to one aspect of the present disclosure, a method of conducting an auction based game between at least two players is provided. The method includes the steps presenting at least one of a mental or physical challenge to the at least two players; crediting a predetermined number of points to each of the at least two players based on an outcome of the challenge; auctioning at least one predetermined prized to the at least two players, the at least two players using the credited points to bid for the predetermined prize; and awarding the at least one predetermined prize to one of the at least two players with the highest bid. The mental challenge may include at least one trivia question.

In one aspect, each of the at least two players are unaware of the other players' credited point total. The at least one predetermined prize is randomly selected from a plurality of predetermined prizes.

In another aspect, the method further includes issuing credits to each of the at least two players for unused points. The issued credits are transferable and are redeemable for a prize. In one aspect, the issued credits are in the form of trading cards, wherein each of the trading cards includes an image of the at least one predetermined prize.

In a further aspect, the at least two players include at least two active players and at least one alternate inactive player. The method further includes removing the one of the at least two players with the highest bid and inserting the at least one alternate inactive player.

In another aspect, the method further includes determining if the one of the at least two players with the highest bid has credited points equal to the highest bid, wherein if the one of the at least two players with the highest bid does not have credited points equal to the highest bid, removing the one of the at least two players with the highest bid from the game. In a further aspect, the method includes associating a challenge card to the at least one of a mental or physical challenge and awarding the challenge card to each of the at least two players based on the outcome of the challenge, wherein if the one of the at least two players with the highest bid does not have credited points equal to the highest bid, a player may use the challenge card to challenge at least one other player for the at least one other player's points. If the challenger loses the challenge, the challenger is removed from the game. If the challenger wins the challenge, the method further includes adding a point total of the at least one other player to the point total of the challenger; determining if the new point total is greater than or equal to the highest bid; and if the determining step is positive, awarding the predetermined prize to the challenger; otherwise, if the determining step is negative, removing the challenger and the at least one other player from the game.

According to another aspect of the present disclosure, a minimum predetermined number of credits for each player is required to participate in the game. A player or contestant may acquire credits by purchasing the credits from at least one other player or from a retail establishment. Furthermore, a player may earn credits from playing online games. The credits are transferable to other players or contestants.

According to a further aspect, a program storage device readable by a machine, tangibly embodying a program of instructions executable by the machine to perform method steps of conducting an auction based game between at least two players is provided, the method steps including presenting at least one of a mental or physical challenge to the at least two players; crediting a predetermined number of points to each of the at least two players based on an outcome of the challenge; auctioning at least one predetermined prized to the at least two players, the at least two players using the credited points to bid for the predetermined prize; and awarding the at least one predetermined prize to one of the at least two players with the highest bid.

According to another aspect of the present disclosure, an auction based game between at least two players includes means for presenting at least one of a mental or physical challenge to the at least two players; means for crediting a predetermined number of points to each of the at least two players based on an outcome of the challenge; means for auctioning at least one predetermined prized to the at least two players, the at least two players using the credited points to bid for the predetermined prize; and means for awarding the at least one predetermined prize to one of the at least two players with the highest bid.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION OF THE PREFERRED EMBODIMENTS

Figure 1:
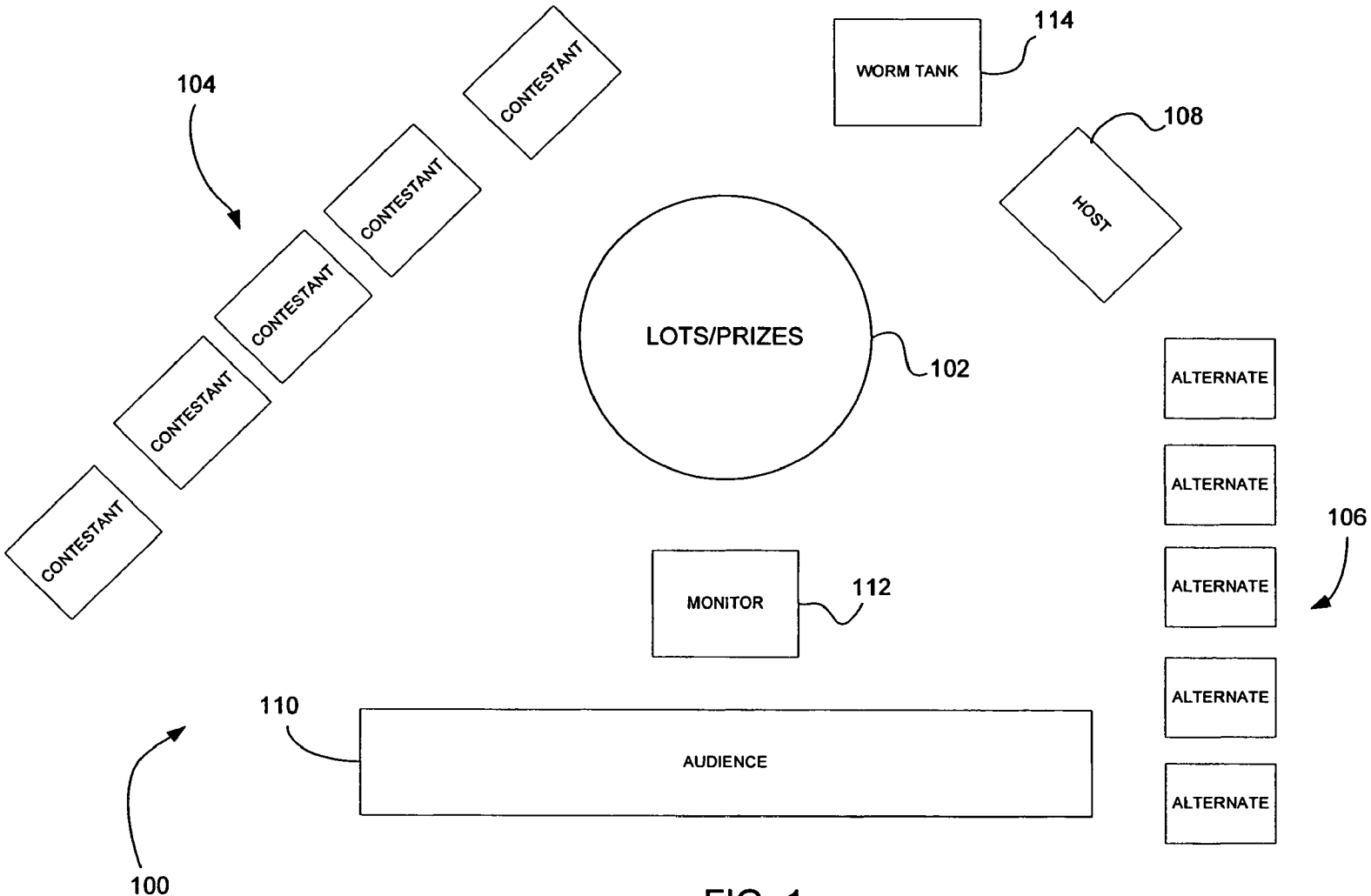
FIG. 1 is a view of a studio setting in which a game show in accordance with an embodiment of the present disclosure is conducted.

The preferred embodiment shown in the accompanying figures, and detailed hereinafter, describes a system and method used to play a TV game show known as and trademarked under the trademark BidZerk!™. It will be evident that the same method which allows the game to be played as a TV game show can also be used to allow the game to be played as a computer/video game, board game or other format.

The game of the present disclosure is an auction game including two parts: (1) a question/answer Trivia Round where contestants accumulate points based on providing correct answers to questions and (2) an Auction Round where contestants bid on lots/prizes with the points they have accumulated during the Trivia Round. In alternative embodiments, the contestants may also accumulate points by performing physical challenges. Contestants will compete for prizes using a variety of cognitive and intellectual skills. The game itself relies on the contestant's ability to draw upon several fundamental educational learning objectives: Logic, Mathematics, Languages, Negotiation, Communication and Quantitative Analysis. Contestants of BidZerk! whom are able to exhibit mental prowess will be rewarded during the game, versus a game show model based upon either pure luck or financial wherewithal.

The game will be played by contestants selected from the studio audience. The studio audience is comprised of 25-35 potential contestants. During the standard half-hour game show format, five (5) contestants will be selected to play the game. Another five (5) will be selected to be alternates. At least two (2) of the alternates are guaranteed to play the game during the show, as will be described below. Under an online streaming version of the game, the show will be edited to a five (5) minute format. The show content does not change. However, only one round of questions is posed, and only one Auction Round is featured.

It is to be appreciated that the studio audience may be assembled in various ways. In one embodiment, potential contestants will enter a lottery to be a member of the studio audience. In another embodiment, potential contestants will collect credits and, when the potential contestants reach a predetermined minimum number of credits, the player will use the credits to obtain a position, either as a contestant or a spectator, on the show when the game is played as a live broadcast game. Players will obtain the credits in various ways, for example, by visiting a web site sponsored by the game show and collecting credits by playing various online games. These credits will be transferable, and therefore, a player may purchase credits needed from other players and, alternatively, may sell excess credits to others. Furthermore, a player may be able to purchase credits at retail locations in the form of trading cards that have various point values. The trading cards may also be used to obtain prizes/lots featured on the show, as will be described in more detail below.

The game will include a cast of characters that will run the game and manage the flow of the game. The game will include at least the following characters:

1. Auctioneer/Host:

Funny, spirited, and very feisty young man. The Host will completely command and direct the flow of bidding as well as the tempo of the show. The Host is one of the stars of the show, a 1*a* Bob Barker, and is a good guy. He speaks quickly, and conducts the actual auction in an up-beat manner.

2. Curator:

Side kick to Auctioneer/Host. The Curator is in charge of showing all of the lots/prizes for each round and gives a description of each prize featured.

3. Warden:

Tough Guy on the set. Stands in front of red ropes protecting the "Lots". May have a side kick bull dog by his side. The Warden's role is to administer justice. He is responsible for the physical comedy, and is in charge of enforcing the rules of the game in the event that the contestants "get out of line". He also puts people into the Worm Tank in the event they are caught "bluff bidding", e.g., don't have enough points to substantiate the payment of the winning bid.

4. Announcer:

Behind the scenes character. Calls the show to order. The Announcer also announces the contestants as they are selected to come out of the audience. He also announces the "lots/prizes" once they are introduced to the set.

FIG. 1 illustrates one embodiment of a studio setting 100 for playing the BidZerk! TV game show. The studio setting 100 will include a podium or platform 102 for displaying lots/prizes, a plurality of podiums for contestants 104, a plurality of podiums for alternate contestants 106, a host podium 108 and a section for a live studio audience 110. The set and staging will be shot based entirely on a "green screen" format. CS will be used in post-production to impart the show's various themes, Therefore, each show will take on a different theme: Circus, Underwater Explorer, Ivanhoe, Wild West etc. This will enable the show to stay "fresh". This theme is exhibited on the green screen surrounding the stage. Contestants and the Host will dress the part of the theme.

A very basic studio can be adapted for the show. There is no stage. The studio will be created by a set designer in a way that to capture the show's theme, build upon audience and contestant excitement while preserving an "auction" environment. The set designer will impart a somewhat unsettling feeling in order to add suspense to the overall dramatic affects of the show. This may be achieved through lighting, flashing strobes, video monitors, as well as in post-production. Music and scoring will be integrated into all elements of the show.

Technology, as expressed by multiple television monitors, set decoration and props, will be prominently featured on the set. A series of "flying cameras" will document the show for home viewers from dozens of unique angles. Television viewers should feel that they have been transported to a unique environment every time they watch the show.

Prominently featured on the large circular podium 102 (e.g., 10-15 ft in circumference) in front of a plush red curtain is a large red hanging rope. Behind the rope lies the treasure: lots/prizes that will be featured for auction during the show. Advertisers will pay for the right to feature their products and merchandise on the BidZerk! show. This is in addition to the traditional sponsorship model employed by the television networks. Alternatively, the increased exposure of the advertiser will significantly leverage the rate card for BidZerk! advertising slots.

In front of the audience 110 are five (5) podiums 104 positioned at forty-five degree angle, behind which the contestants stand. Immediately in front of the stage is a large monitor 112 directed at the audience 110. This monitor 112 displays each of the contestant's name and total point score. Contestants are not able to view this screen, nor are they aware of the others points during the show. On the top of each of the contestant podiums 104 are laptop computer screens, touch screens or the like. On the actual contestant screen are three (3) touch sensitive buttons selections. Each button will correspond to an answer in the format of A, B, C (or 1, 2, 3 if elected).

The Host stands behind the podium 108 which is positioned at a forty-five degree slant toward the contestants. This will allow the Host to address the contestants and the audience simultaneously. A flat screen computer panel is mounted on the podium 108. This monitor will provide the Host with: Contestant Names; Contestant Point Totals; Questions & Answers (Used during Trivia Question round); and Summary of Real-time Point Totals (Used during Auction Round).

Figure 2:
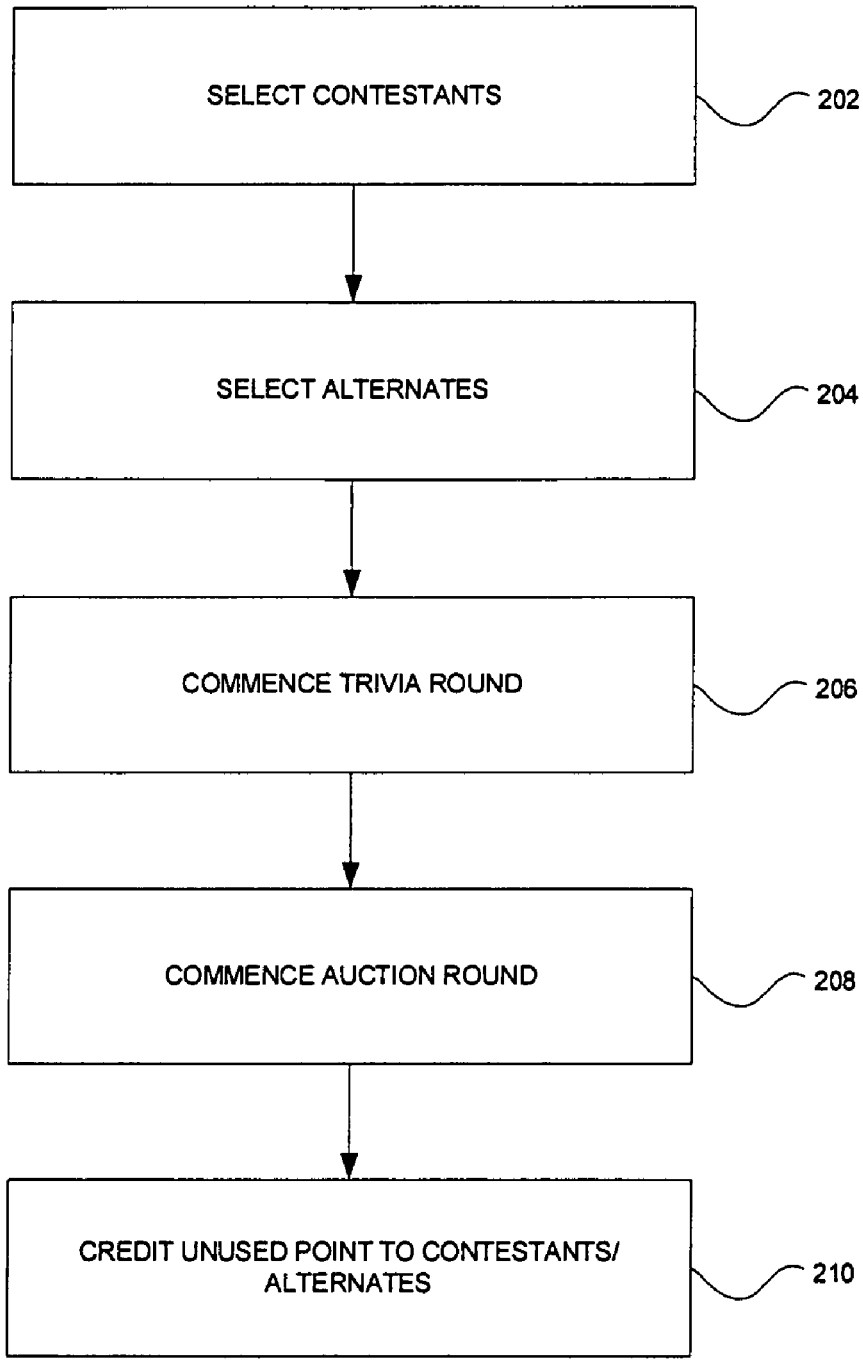
FIG. 2 is a flowchart illustrating a method for playing the game in accordance with an embodiment of the present disclosure.

Referring to FIG. 2, an overall process for playing the game of the present disclosure is illustrated. Initially, a random group of five (5) contestants are called down to the staging area by the Host (step 202). They take their position behind the contestant's podiums 104. Another five (5) alternates are selected from the audience (step 204). They are seated stage right of the Host at podiums 106. When directed by the Host, each of the contestants states his/her name and age. Once all five (5) contestants and alternates are identified, the game is ready to begin.

The Host proceeds to quickly describe the game, basic rules, and the prizes they will be playing for, for the benefit of the studio and home audience. The Curator of the show will describe each lot/prize as the Auction Round commences.

The BidZerk! game itself will be broken down into two parts: a Trivia (Question & Answer) Round (step 206) leading to a live Auction Round (step 208). When conducting the game as a TV show, there will be enough time within the 17 (+/−) minute show allotment to feature two (2) Trivia Rounds and two (2) corresponding Auction Rounds per half-hour taping session. During the on-line program, the show is reduced to a five (5) minute segment, including one (1) Trivia Round and one (1) Auction Round.

Figure 3:
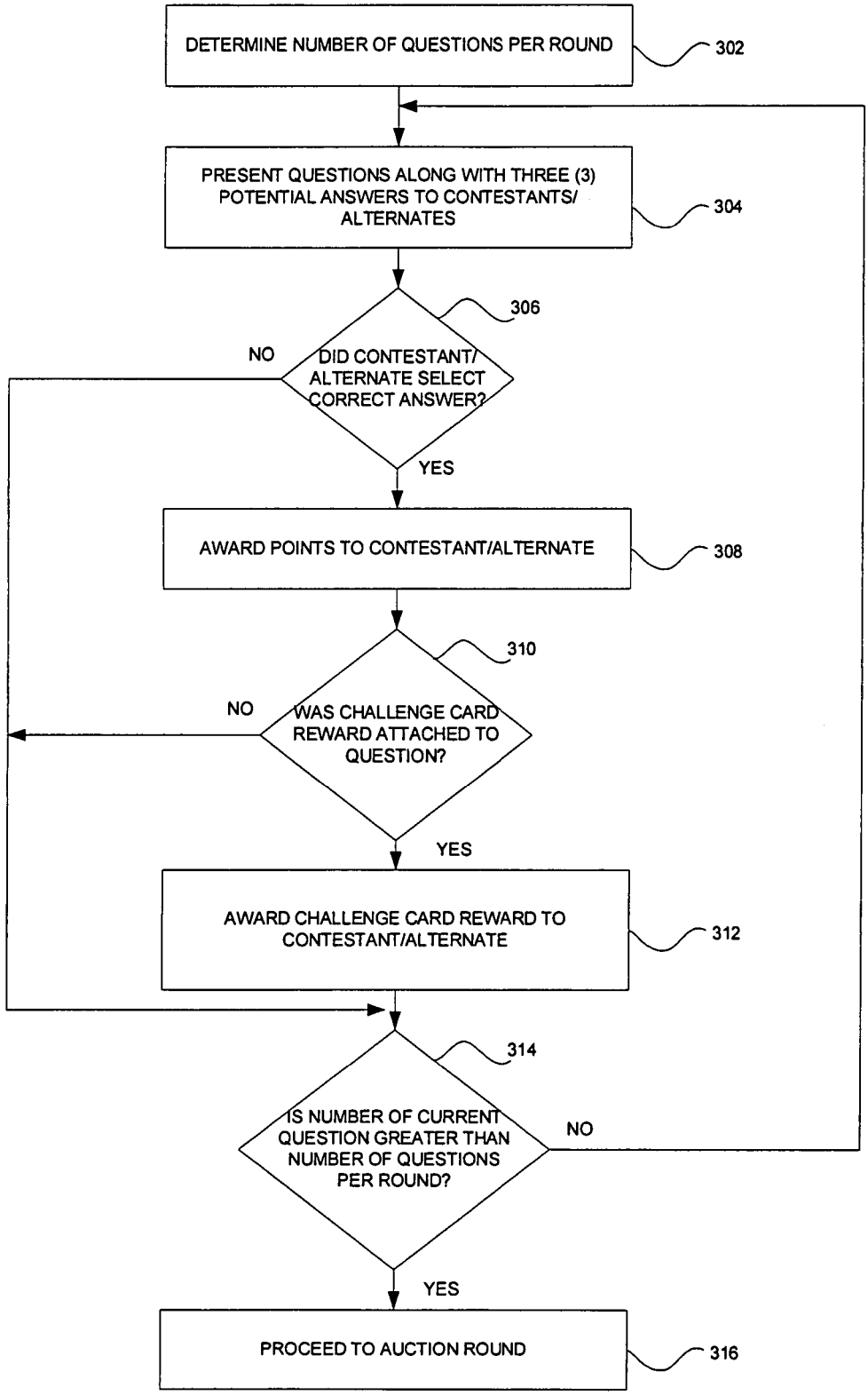
FIG. 3 is a flowchart illustrating a method for playing a question and answer round of the game of the present disclosure.
Figure 4:
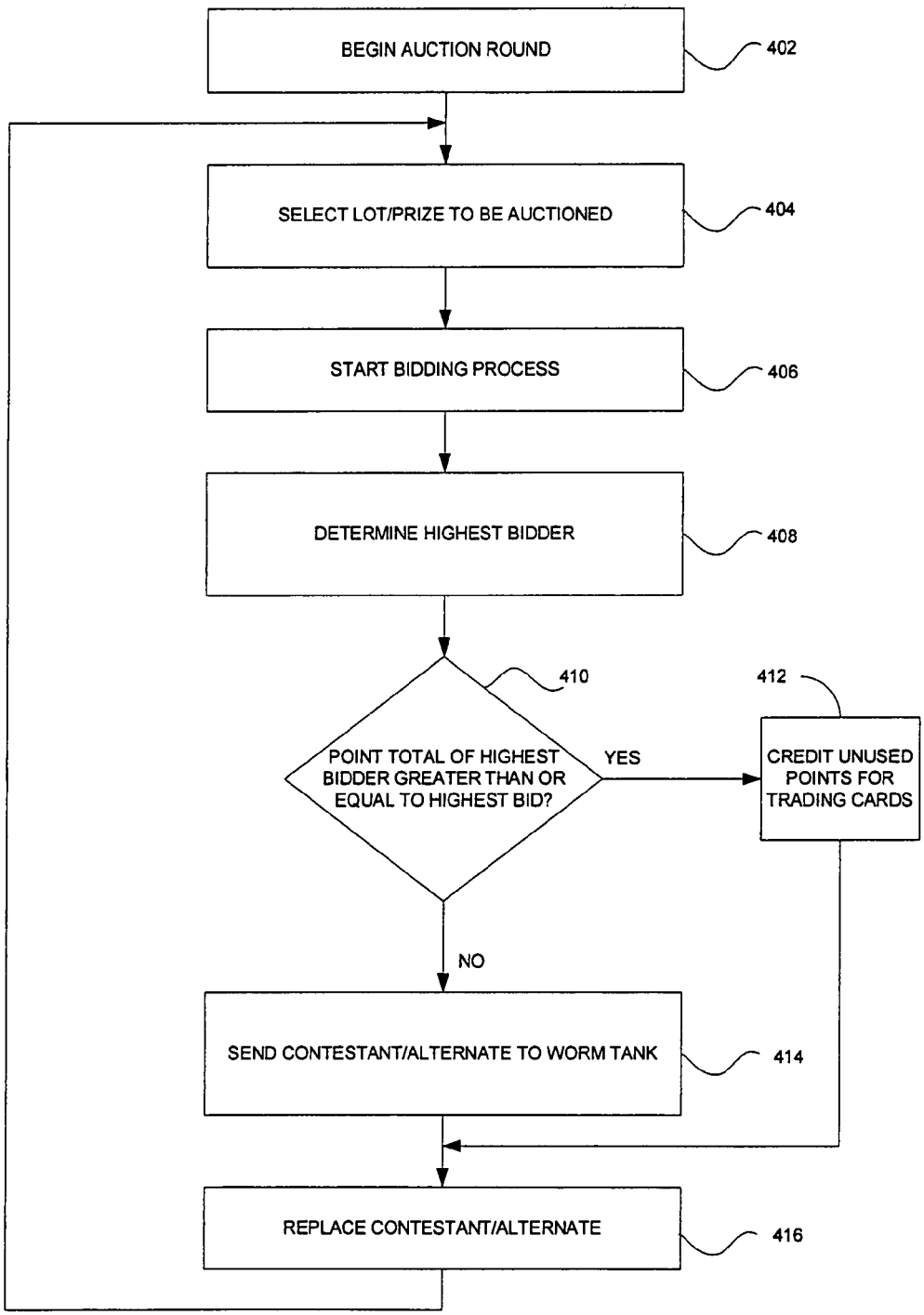
FIG. 4 is a flowchart illustrating a method for playing an auction round of the game of the present disclosure.

The Trivia Round will now be described in relation to FIG. 3. In step 302, a number of questions to be asked per round is determined. During the Trivia Round, ten (10) questions and potential answers are read by the Host to the contestants and alternates one question at a time (step 304). Each question will be followed by three (3) potential answers. Only one of the potential answers will be correct. The questions and answers will appear on each of the contestant's screen monitor as they are read by the Host.

The Host stands behind his podium and has the questions presented to him on the flat screen monitor in front of him from which he reads. The audience can clearly see each question, as well as the corresponding answers that each contestant has selected, on the studio monitor(s) 112 positioned above the stage. Each question has three (3) possible answers correlating to the A, B, C buttons on each contestant's screen located on top of their podiums. Contestants touch the monitor with their answer. The answers are automatically recorded in the computer. Points are automatically awarded to contestants for their correct answers, and are displayed after each question on the contestant's own monitors, as well as on the monitor(s) facing the audience.

The basis for the questions in the Trivia Round are drawn from variety of topics ranging from current events to age-appropriate trivia. In addition, special questions pertaining to math, sciences, language etc. are easily formatted into the Trivia Round contingent upon on the educational demographics. Special shows may be created which focus on specific educational related topics.

Contestants and alternates must answer each question, or make an educated guess at each in a quick manner (step 306). The contestants and alternates will accumulate points for each correct answer (step 308). Neither contestants nor alternates are penalized for incorrect answers.

Questions have numerical points assigned to the correct answers, with the more difficult ones being worth substantially more points. Contestants and alternates are able to immediately determine whether they answered the questions correctly, since they will see their individual point totals increasing on their own monitor correlating to their response. However, they will be unaware of their opponent's point valuations during the Trivia Round.

In one embodiment, the Trivia Round will include a physical challenge to be performed by the contestants. For example, the contestants might have to run a race, complete an obstacle course, etc. The physical challenges have numerical points assigned to the each challenge, with the more difficult ones being worth substantially more points. The points from the physical challenges will be added to the points accumulated from the trivia questions.

During the Trivia Round, one of the tougher answers, selected at random, will have a special CHALLENGE CARD reward attached (step 310). If a contestant or alternate answers the designated question correctly, they will be entitled to collect the CHALLENGE CARD (step 312). If the contestant uses the CHALLENGE CARD successfully, they may be able to win more points to be used during the Auction Round, as will be described in detail below. The CHALLENGE CARD reward shows up on the contestant's monitor as an icon in the corner. The audience can also see on the studio monitors which contestants actually have won the CHALLENGE CARD(s). It is to be appreciated that a physical challenge may also have a CHALLENGE CARD associated with it.

At the end of the ten (10) question Trivia Round (step 314), each of the five (5) contestants and five (5) seated alternates will have accumulated a certain number of points based upon the number of correct and incorrect answers. Each contestant and alternate has the opportunity to accumulate a predetermined number of points, e.g., 1000 points provided that they answer all of the questions correctly. Since neither the contestants, alternates or audience know how many points each of their opponents have accumulated at the end of the Trivia Round, there is a substantial level of anticipation and suspense that has been built up entering the actual Auction Round (step 316).

Once the Trivia Round is complete, the Auction Round will begin (step 402). During the Auction Round, a series of three (3) lots/prizes are auctioned. The lots are drawn from the official BidZerk! Catalogue (step 404). Lots/prizes consist of toys, games, trips, computer equipment, sporting goods and other awards selected by the "Official Sponsors" of the show. The Curator quickly describes each prize that will be auctioned. A key element is that the contestants are not aware of the order that any of the prizes will come up during the actual auction, nor are they aware of what prizes will be selected during their Auction Round. This will add to the excitement of the studio and home audience. The lots/prizes are drawn at random to determine their presentation sequence. Some of the lots/prizes may not appear during that Auction Round series or during the telecast.

The Auction Round will be more clearly described in relation to the following example. In this example, each of the five (5) contestant have accumulated points, illustrated below, from the Trivia Round as a result of the contestants' correct answers. The studio and at home audience can see the point totals for each contestant on the video monitors. However, the contestants themselves are unaware of their competitors accumulated point totals thus far:

| Jimmy | Mary | John | Katie | Nick |
|---|---|---|---|---|
| 300 pts | 750 pts | 900 pts | 885 pts | 1,000 pts |

The Curator selects the first "Lot" to be auctioned (step 404). The lot is prominently featured on the circular pedestal 102 for all to see. The Auctioneer starts the bidding process with a minimum "floor bid" (step 406). The contestants are free to bid up the perceived value, based upon their own point totals, until there are no more bids. The Host/Auctioneer drives up bids, and talks up the lot featured during the round.

Contestants place their bids by raising their individual Auction Paddles. The Paddles may be in the form of a mini-light saber, similar to those used by police to direct traffic. When they squeeze the light button on the handle of the saber, it illuminates. The Host acknowledges the bid. A winner is declared by the Auctioneer based upon the highest bid (step 408). The Auctioneer brings the winner up to the red rope adjacent to the prize platform to claim their lot/prize.

Winning contestants are not allowed to reenter the bidding on other prizes. However, their unused points will be credited toward trading cards (step 412) as will be described in more detail below. One of the alternates is selected at random to replace the winning contestant's spot for the next Auction Round, since they have also accumulated points during the Trivia Round, they are ready to play.

The contestants have several options or strategies to consider during the actual Auction Round:

1. The contestant may elect to "hold out" and refrain from bidding at all.

Rationale:

A contestant would elect to "hold out" from bidding with the hope of being able to participate in the next round of the auction for a prize that means more to him/her. The risk to this strategy is that the contestant may not actually have enough points accumulated from the Trivia Round to actually "win" the next round. And since he/she is unaware of the other contestant's actual running point totals, they risk not being able to win anything at all by holding out.

2. The contestant can choose to participate in the bidding process for the round until they feel that they cannot afford to, or are uncomfortable bidding the value up any further.

Rationale: The contestant can drop out of that round of bidding without a penalty and without the loss of points provided that they were not the final winning bid for the round. They, in essence, are able to save their points for the next "Lot" within that Auction Round series.

3. The contestant may choose to enter a "bluff bid" at any point during an Auction round.

Rationale:

A contestant would enter a "bluff bid" with the hopes of achieving one of two goals:

i) Knock out an opponent from the round by making them spend all of their points on a specific "Lot", or ii) Use the "bluff bid" strategy to make the other contestants believe, or be under the impression, that they have more points than they actually do from the Trivia Round!

If the other contestants think that they are still in contention, it somewhat equalizes the playing field. When in fact, that contestant—the one with a low point total—may have only answered a few questions correctly from the Trivia Round.

As long as the contestant who elects to "bluff bid" actually has the points to pay for the lot/prize, and they are the last bid accepted by the Auctioneer, they will win the lot/prize and their account would be debited by the number of points used for the final bid (step 410). Conversely, if a contestant elects to enter a "bluff bid", and he/she doesn't have the points to support the final bid, the contestant would be immediately relegated to the "Worm Tank" 114 (step 414).

The Worm Tank is a place where contestants are placed when they are caught bluff bidding without the supporting points to pay for the lot/prize. The Worm Tank is designed as a form of physical comedy; one considered "gross" by both contestants and the audience. The actual structure of the Worm Tank may be a booth with a chair and is situated on the corner of the staging area.

Surrounding the person in the Worm Tank is a green screen. The Worm Tank is enclosed on all four sides, sort of like a penalty booth. Using CG, on the monitors the audience sees the unlucky contestant surrounded by disgusting piles of worms and leaches. Alternatively, the punishment viewers see on the green screen could consist of a "pus pile", or "vat of goo" etc. The logic was to come up with a penalty that generates lots of laughs, but does not place the contestant in any physical danger thus avoiding additional mess and potential litigation. The Warden approaches the offending contestant's podium and physically places that contestant into the Worm Tank for the duration of the show. That contestant loses all of their points, but leaves the show with some parting gifts.

By placing the offending contestant into the Worm Tank, the show emphasizes that it is not "OK" to spend the de facto money/points that you, the contestant, don't actually possess. It is a risky strategy in the game, as well as in life. However, there is a real world element that WILL reward contestants who are either able to drive up, or drive down, bids without getting caught holding the bag without points to support the bid. (Similar to bluffing elements found in the games of Bridge, Gin Rummy, and Poker).

During the actual Auction Round(s), the studio and home audience get an inside look at each contestant and alternate's accumulated point totals. The sense of excitement builds during the actual Auction Round, when based upon the strategy elected by the other opponents, a contestant could shrewdly bid on the lots/prizes. However, there is a chance that contestants hold out too long, or don't have the points necessary to actually win the Auction Round.

In one embodiment of the game, a contestant that does not have enough points may used the Challenge Card, if obtained during the Trivia Round. However, none of the other contestants or alternates will know who has, or has not, won the CHALLENGE CARD(S). The Auctioneer will announce at the end of the Trivia Round whether there were, or were not, CHALLENGE CARD(S) issued during the round. This will test the contestant's poker face at the end of the round. This will also serve to notify the contestants that there is a possibility of challenges taking place during the upcoming Auction Rounds. In theory, all of the contestants could win a CHALLENGE CARD, which they may elect to use at any time during the actual Auction Round.

The CHALLENGE CARD serves a special function during the Auction Round. If a bidder holding the CHALLENGE CARD uses a bluffing strategy during the Auction Round, and ends up having the final bid, but doesn't have the points to pay for the prize, they can elect to utilize the CHALLENGE CARD in order to get more points. In essence, a contestant could select any other contestant and challenge them on the spot for their points during a one question Speed Round. During the Speed Round, the Host reads a special question, or series of questions, which has been selected in advance for this purpose. The contestant who answers the question correctly in the fastest time wins the Challenge. However, in the unlikely event that neither contestant correctly answers the first question, the Host presents a new question. This process is repeated until one of the two contestants answers the Challenge question correctly. Of course, the contestant using the CHALLENGE CARD is unaware of the actual points that the contestant who they have selected for the Speed Round has accumulated.

In the event that the challenger loses the Speed Round question, the contestant who was challenged is automatically awarded the lot/prize, or may choose to pass on the prize and not utilize his points. In the later case, that person keeps his points and continue to the next round of the auction. At no time does the challenged person have to reveal the number of points that they actually have, thereby maintaining the suspense of the show. The losing contestant is relegated to the Worm Tank for the duration of the show. One of the alternates is now brought up to the former contestant's podium, and is in position to bid on the next auction round.

In the event that the contestant holding the CHALLENGE CARD wins the challenge, there is not guarantee that the person they challenged has enough points, which when combined with their own total, are able to actually pay for the lot/prize that they won. In this case, both the Challenger and the person who was challenge end up in the Worm Tank. Therefore, two of the alternates replace the losing contestants and the game resumes.

There are two possible scenarios for dealing with unused points. In the first scenario, during the Auction Round, the winner of the lot/prize doesn't expend all of the points that they have earned during the Speed Round. Any unused points could be attributed to trading cards, e.g., each point could be worth one or more cards. In the second scenario, at the end of the Auction Round, there may be contestants who did not win anything for a variety of reasons, not the least of which is that they did not bid correctly, or did not accumulate enough points to be in contention. Therefore, it is possible that they walk away with 600-800 points. These could be turned into de facto currency in the form of trading cards or parting gifts, e.g., each point could be worth one card.

During each show, one of the two (2) auctions will have a prize that may contain a "Bonus" prize inside, or attached, in the form of a gift certificate. The winning contestant's bid receives the featured prize along with the Bonus. They also automatically gain entry into the "Super Auction" at the end of the month or series during a special show. In addition, they will qualify for more de facto currency, or automatically gain super points to be used in conjunction with the trading cards.

Figure 5:
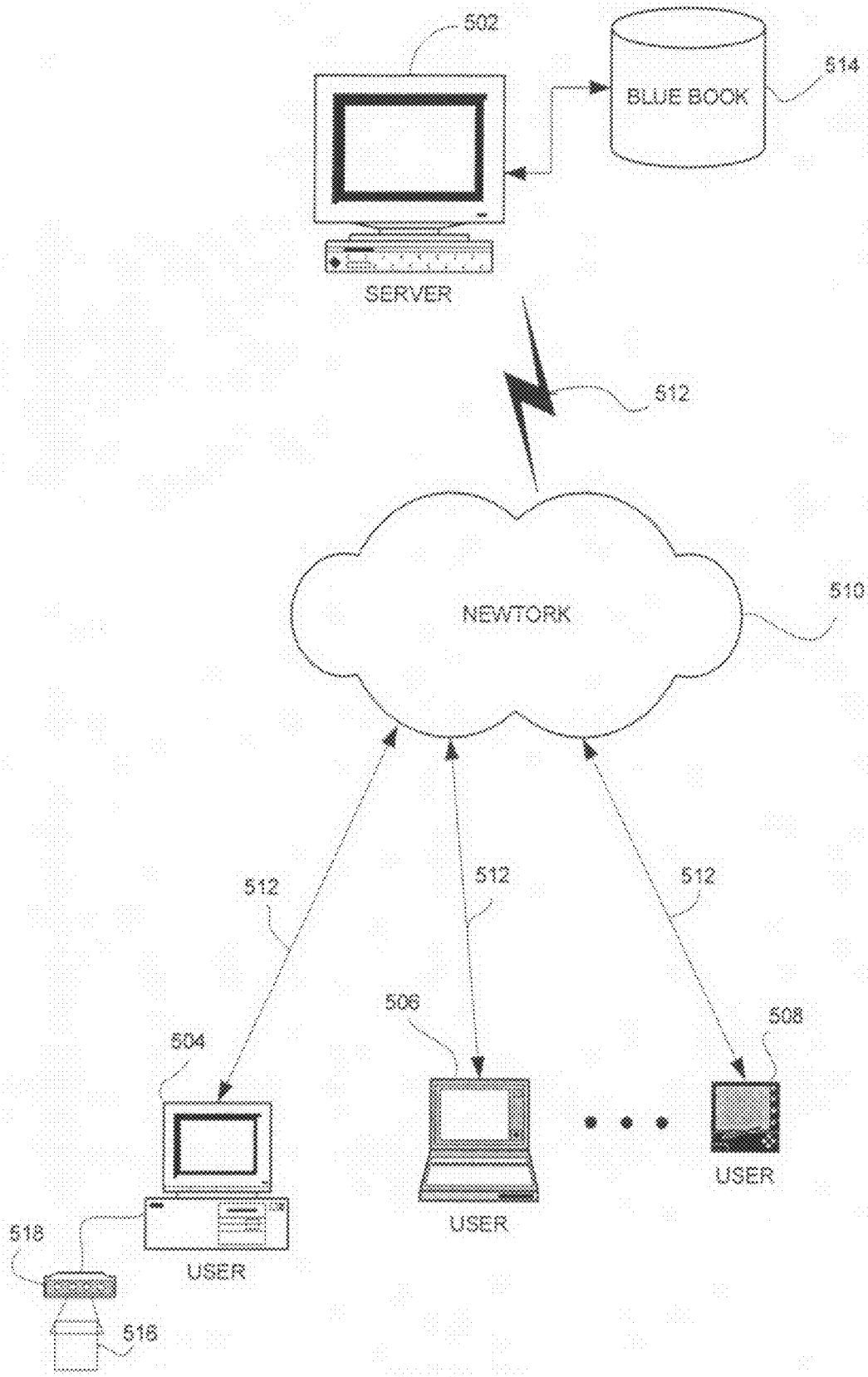
FIG. 5 is a system diagram for playing an online version of the game in accordance with the present disclosure.

In another embodiment, a web site is provided to implement an on-line version of the game. Preferably, the web site is located at bidzerk.com. Referring to FIG. 5, the on-line game will be implemented on server 502. Contestants and/or alternate contestants will play the game by accessing the server 502 via a client computer 504, 506, 508. The server 502 will be coupled to the client computers via a network 510, e.g., the Internet. The client computers 504, 506, 508 will access the server using any conventional Internet web browser, e.g., Microsoft™ Internet Explorer. The server 502 will includes a plurality of databases, e.g., a Blue Book database 514 which will be described below.

It is to be understood that the present disclosure may be implemented in various forms of hardware, software, firmware, special purpose processors, or a combination thereof. In one embodiment, the present disclosure may be implemented in software as an application program tangibly embodied on a program storage device. The application program may be uploaded to, and executed by, a machine comprising any suitable architecture such as a personal computer, a workstation or server. Preferably, the machine is implemented on a computer platform having hardware such as one or more central processing units (CPU), a random access memory (RAM), a read only memory (ROM) and input/output (I/O) interface(s) such as a keyboard, cursor control device (e.g., a mouse or joystick) and display device. A system bus couples the various components and may be any of several types of bus structures including a memory bus or memory controller, a peripheral bus, and a local bus using any of a variety of bus architectures. The computer platform also includes an operating system and micro instruction code. The various processes and functions described herein may either be part of the micro instruction code or part of the application program (or a combination thereof which is executed via the operating system.

In addition, various other peripheral devices may be connected to the computer platform by various interfaces and bus structures, such a parallel port, serial port or universal serial bus (USB). One such peripheral device may include a communications device, e.g., a modem, satellite relay, wireless connection, etc., for enabling communications from the server 502 to the client computers 504, 506, 508. Other peripheral devices may include additional storage devices and a printer.

It is to be further understood that, because some of the constituent system components and method steps depicted in the accompanying figures may be implemented in software, the actual connections between the system components (or the process steps) may differ depending upon the manner in which the present disclosure is programmed. Given the teachings of the present disclosure provided herein, one of ordinary skill in the related art will be able to contemplate these and similar implementations or configurations of the present disclosure.

The server 502 may operate in a networked environment using logical connections to one or more remote computers, e.g., client computers. The remote computer may be a personal computer, a server, a router, a network PC, a peer device, a personal digital assistant, a mobile phone or other common network node, and typically includes many or all of the elements described above relative to the machine. It is to be appreciated that the network 510 may be a local area network (LAN), wide area network (WAN), the Internet or any known network that couples a plurality of computers to enable various modes of communication via network messages. The clients may communicate to the server 502 and network 510 via any known communication link 512, for example, dial-up, hardwired, cable, DSL, satellite, cellular, PCS, wireless transmission (e.g., 802.11a/b/g), etc. Furthermore, the devices will communicate using the various known protocols such as Transmission Control Protocol/Internet Protocol (TCP/IP), File Transfer Protocol (FTP), Hypertext Transfer Protocol (HTTP), etc. During a purchasing transaction, the computing devices may employ Hypertext Transfer Protocol Secure (HTTPs), Secure Sockets Layer (SSL) Protocol, Secure Electronic Transaction (SEC) Protocol, etc.

Besides implementing an on-line version of the game of the present disclosure, the web site will complement the television version of the game. The BidZerk! web site has been designed to provide eight core functions: (1)"Blue Book" Reference with details for lot/prize redemption from trading cards; (2) simulated gaming experience (Mirrors the Television Broadcast); (3) Trading Card Center—tips and strategies for playing the game; (4) links to Sponsors for On-Line Merchandise Sales; (5) Chat Room capability; (6) "Wish List" (Registry for lots/prizes that kids want for birthday, Christmas, etc); (7) BidZerk! Kid's Club (Enrollment, Email & Special Promotions); and (8) registration for kids to try to get on the BidZerk! Television Show.

As described above, unused points accumulated during the game will be credited to contestants and alternates in the form of trading cards. A series of proprietary trading cards based upon the theme of the show have been created. Each lot/prize featured on the show corresponds to a trading card. Each card has a facsimile image of the prize printed on the face of the card. On the back of the card is a full description of the toy, prize, or award history, and other highlights/trivia that the manufacturer or sponsor of the lot/prize wishes to include. Optionally, the trading cards will include holograph and bar code information printed on the card to help prevent forgery.

A "Blue Book" value of the trading cards will be created and maintained in database 514. The Blue Book serves two functions: 1) users will be able to quickly reference how many cards are needed to win special lots/prizes and 2) the Blue Book will feature the new lots/prizes featured for auction. Advertising revenues will be generated from this site from the sponsors of the lots/prizes.

Contestants/alternatives are able to scan the bar code on each card 516 with a scanning device 518, e.g., a Qcat™ commercially available from Digital Convergence Corporation. This bar code reading device attaches to the USB port on a client computer 504 as shown in FIG. 5. Once the code is scanned, a user is instantly connected to the bidzerk.com website and will access the "Blue Book" section. Additional technology has been integrated into the scanner platform to deliver specific information to advertisers and sponsors related to contestant habits related to the trading cards. When accessing the Blue Book database, a user will be able to determine the quantity of points/trading cards are needed to acquire the item of interest. Furthermore, the user will be able to access further information regarding the item and/or may be linked to a web site of the manufacturer of the item.

Alternatively, an individual microprocessor chip may be implanted into the trading cards, or a simple magnetic swipe feature may be included. This would be used by the person holding the trading card to potentially win special prizes not listed graphically on the card itself. This information would also provide fundamental marketing information to server 502 for data mining purposes. The swipe feature would be supported by the scanning element integrated into a home computer format, as described above, as well as at a retail distributor.

When a user or player of the game collects a certain predetermined number of cards with the image of the lot/prize that they wish to acquire, derived from the "Lots Catalogue" featured on the television show and on the web site, they will be able to turn in their cards to actually take possession of the lot/prize. Alternatively, trading cardholders will be able to turn in a predetermined prize redemption level of trading cards and receive a substantial discount on the featured lot/prize from the distributor, e.g., Wal Mart, KB Toys, KMART, TOYS R US, etc. Furthermore, special trading cards, or limited editions, will be tied in to restaurant merchandizing programs (e.g., McDonalds, Wendy's, Burger King, Taco Bell) as sponsored by those restaurants, thus driving sales, increasing brand awareness, and generating traffic for the restaurant. Additionally, a certain number of trading card packs will contain a special "X" card. Possession of the "X" card can serve multiple purposes: accelerate the total number needed to collect the prize, or be worth a special prize unto itself. The "X" card holder may be entitled to be a contestant on the live show.

The focus of the trading cards and distribution strategy is to drive sales of toys, games etc. in a predetermined and structured manner. Retailers and manufacturers will be able to schedule the launch of new products via the trading cards. The provider of the game and server will be entitled to a percentage of these sales as expressed as a percentage of licensing fees and royalties paid by the distributor/manufacturer based upon purchasing trends of the lots/prizes featured. Manufacturers will have a substantial incentive to pay royalty fees to the provider of the BidZerk! game provided the provider is able to create or promote unique properties featured either on the Television show or on the official web based the lot/prize catalogue.

It is to be appreciated that game and method of playing same in accordance with the present disclosure may be implemented in various forms such as in a stand-alone software product without requiring an Internet connection. Furthermore, the game may be implemented as a board game which will parallel the television version and feature attributes of the show.

While the disclosure has been shown and described with reference to certain preferred embodiments thereof, it will be understood by those skilled in the art that various changes in form and detail may be made therein without departing from the spirit and scope of the disclosure.

What is claimed is:

1. A method of conducting an auction based game between at least two players, the method comprising the steps:

presenting, via a web site executing on a server, at least one of a mental or physical challenge to the at least two players;

crediting, by the server, a predetermined number of points to each of the at least two players based on an outcome of each challenge;

auctioning, by the server, at least one predetermined prize to the at least two players, the at least two players using only the credited points accumulated from each challenge to bid for the predetermined prize;

awarding, by the server, the at least one predetermined prize to one of the at least two players with the highest bid; and determining if the one of the at least two players with the highest bid has credited points equal to the highest bid, wherein if the one of the at least two players with the highest bid does not have credited points equal to the highest bid, removing the one of the at least two players with the highest bid from the game.

2. The method as in claim 1, wherein the mental challenge is at least one trivia question.

3. The method as in claim 1, wherein each of the at least two players are unaware of the other players' credited point total.

4. The method as in claim 1, wherein the at least one predetermined prize is randomly selected from a plurality of predetermined prizes.

5. The method as in claim 1, further comprising issuing credits to each of the at least two players for unused points.

6. The method as in claim 5, wherein the issued credits are transferable.

7. The method as in claim 5, wherein the issued credits are redeemable for a prize.

8. The method as in claim 5, wherein the issued credits are in the form of physical trading cards, each trading card having a predetermined value and used to purchase prizes.

9. The method as in claim 8, wherein each of the trading cards includes an image of the at least one predetermined prize.

10. The method as in claim 1, wherein the at least two players include at least two active players and at least one alternate inactive player.

11. The method as in claim 10, further comprising removing the one of the at least two players with the highest bid and inserting the at least one alternate inactive player.

12. A method of conducting an auction based game between at least two players, the method comprising the steps:

presenting, via a web site executing on a server, at least one of a mental or physical challenge to the at least two players;

crediting, by the server, a predetermined number of points to each of the at least two players based on an outcome of each challenge;

auctioning, by the server, at least one predetermined prized to the at least two players, the at least two players using only the credited points accumulated from each challenge to bid for the predetermined prize; and awarding, by the server, the at least one predetermined prize to one of the at least two players with the highest bid;

determining if the one of the at least two players with the highest bid has credited points equal to the highest bid; and associating a challenge card to the at least one of a mental or physical challenge and awarding the challenge card to one of the at least two players based on the outcome of the challenge.

13. The method as in claim 12, further comprising, wherein if the one of the at least two players with the highest bid does not have credited points equal to the highest bid, using the challenge card by a first player to challenge at least one other player for the at least one other player's points.

14. The method as in claim 13, wherein if the first player using the challenge card loses the challenge, removing the first player using the challenge card from the game.

15. The method as in claim 13, wherein if the first player using the challenge card wins the challenge, further comprising:

adding a point total of the at least one other player to the point total of the first player using the challenge card;

zeroing the point total of the at least one other player;

determining if the new point total is greater than or equal to the highest bid; and if the determining step is positive, awarding the predetermined prize to the first player using the challenge card.

16. The method as in claim 13, wherein if the first player using the challenge card wins the challenge, further comprising:

adding a point total of the at least one other player to the point total of the first player using the challenge card;

zeroing the point total of the at least one other player;

determining if the new point total is greater than or equal to the highest bid; and if the determining step is negative, removing the challenger and the at least one other player from the game.

17. The method as in claim 1, requiring a minimum predetermined number of credits for each player to participate in the game.

18. The method as in claim 17, further comprising purchasing credits from at least one other player or from a retail establishment.

19. The method as in claim 17, further comprising earning credits from playing online games.

20. The method as in claim 17, wherein the credits are transferable.

21. A board game using the method of claim 1.

22. A broadcast television program using the method of claim 1.

23. An interactive environment using the method of claim 1, wherein the interactive environment is selected from the group consisting a computing environment, an online environment, a web-based environment, a television environment in a game show format; a radio environment in a radio talk show format; or a wireless communications environment in a cellular or mobile phone game format.

24. The method as in claim 12, further comprising issuing credits to each of the at least two players for unused points.

25. The method as in claim 24, wherein the issued credits are transferable.

26. The method as in claim 24, wherein the issued credits are redeemable for a prize.

27. The method as in claim 26, wherein the issued credits are in the form of trading cards.

* * * * *